US005666917A

United States Patent [19]

Fraser et al.

[11] Patent Number: 5,666,917

[45] Date of Patent: Sep. 16, 1997

[54] SYSTEM AND METHOD FOR IDLE SPEED CONTROL

[75] Inventors: Andrew Donald James Fraser, Ingatestone, England; John Stephen Mills, Novi; Davorin David Hrovat, Dearborn, both of Mich.

[73] Assignee: Ford Global Technologies, Inc., Dearborn, Mich.

[21] Appl. No.: 468,121

[22] Filed: Jun. 6, 1995

[51] Int. Cl.[6] ..... F02D 41/08; F02D 43/00

[52] U.S. Cl. ..... 123/339.11; 123/339.17; 123/339.18; 180/69.3

[58] Field of Search ..... 123/339.11, 339.16, 123/339.17, 339.18; 180/69.3

[56] References Cited

U.S. PATENT DOCUMENTS

| | | | |
|---|---|---|---|
| 4,467,761 | 8/1984 | Hasegawa | 123/339.18 |
| 4,545,449 | 10/1985 | Fujiwara | 123/339.16 |
| 4,582,032 | 4/1986 | Hara et al. | 123/339.11 |
| 4,724,810 | 2/1988 | Poirier et al. | 123/339.16 |
| 5,249,559 | 10/1993 | Weber et al. | 123/339.17 |

FOREIGN PATENT DOCUMENTS

| | | | |
|---|---|---|---|
| 58-187553 | 11/1983 | Japan | 123/339.16 |
| 4-132853 | 5/1992 | Japan | 123/339.17 |

*Primary Examiner*—Andrew M. Dolinar

*Attorney, Agent, or Firm*—Peter Abolins; Roger L. May

[57] ABSTRACT

A system and method for engine idle speed control delay operation of a vehicle accessory (26) while introducing a stored torque disturbance profile corresponding to that vehicle accessory into a feedforward engine control system so as to minimize variation of engine idle speed. Torque disturbances resulting from operation of an alternator (32), power steering pump (28), or air conditioning compressor and blower (30) are characterized and stored in the memory of an electronic control module (22). When a request for operation of an accessory is detected, the stored profile is fed into the control system prior to actual operation of the accessory so as to reduce or eliminate control system response time. Control logic (22) also provides a learning function by modifying the stored profiles to accommodate changes in engine and accessory operation.

17 Claims, 9 Drawing Sheets

SYSTEM AND METHOD FOR IDLE SPEED CONTROL

TECHNICAL FIELD

The present invention relates to a system and method for improving idle speed control in vehicular applications.

BACKGROUND OF THE INVENTION

The continuing evolution of microprocessor control has afforded increasingly sophisticated vehicular control systems. improvements in hardware, including greater memory capacity and faster microprocessors, have facilitated implementation of complex control strategies. In particular, engine control strategies have become more sophisticated to accommodate the various conditions encountered during normal engine operation.

One particularly challenging control function is that of idle speed control (ISC). A number of constraints are placed on the control of engine idle speed, including maintaining satisfactory fuel economy, meeting emissions requirements, and maintaining acceptable driveability. Variations in idle speed are particularly noticeable to vehicle occupants since the engine is operating at a relatively low speed and external distractions, such as road noise or wind noise, are typically negligible or minimal. Furthermore, the low operating speed of the engine produces a relatively low amount of available power at a time when accessory load may be at its highest level. For example, power steering demand is greater while the vehicle is stationary or is slowly moving than when traveling at highway speeds. Similarly, many accessories may be operated shortly after starting a vehicle as the driver adjusts the vehicle environment for his or her preferences. These accessories may include the headlamps, air conditioning or defrost, power windows, power seats, and lights. Shifting an automatic transmission from park to reverse or drive also imposes a load on the engine.

Preferably, the engine control system will maintain a substantially constant idle speed while being subjected to various disturbances associated with operation of numerous engine accessories. In addition, it is important to avoid engine stall as a result of an unexpected load on the engine.

Prior art ISC strategies react to load torques only after the occurrence of the disturbance. Some systems attempt to anticipate the occurrence of a load disturbance without accounting for the engine system dynamics, which may result in undesirable idle speed variations. Other prior art systems utilize feed-forward control strategies so that the control actions start concurrently with (but not before) the start of the torque disturbance. Although this strategy improves the response time of the control system, it is still susceptible to noticeable variations of engine idle speed.

SUMMARY OF THE INVENTION

Thus, it is an object of the present invention to utilize preview control and appropriate engine modeling to maximize the benefit of advance information, so as to reduce variation in engine idle speed when the engine is subjected to a disturbance torque.

In carrying out this object and other objects and features of the present invention, a system and method are provided for storing disturbance torque profiles associated with operation of various engine accessories and injecting at least one stored torque disturbance profile into the control system prior to the actual occurrence of that torque disturbance so as to reduce the response time of the control system and minimize variation of the engine idle speed. The present invention also includes modifying one or more of the stored torque disturbance profiles based on one or more corresponding actual torque disturbances which occur during normal engine operation. This feature of the present invention provides a learning function so that the various torque disturbance profiles are continuously adjusted to accommodate changes in the engine and accessories over time.

There are numerous advantages accruing to the present invention. For example, the present invention optimizes the control system response by utilizing a stored torque disturbance profile in conjunction with preview control. By anticipating a particular torque disturbance, the control system can respond appropriately so that variations in the idle speed are minimized or, ideally, eliminated. Furthermore, by maintaining a substantially constant idle speed, the occurrence of engine stall is substantially eliminated.

The above objects, features, and advantages of the present invention will be readily appreciated by one of ordinary skill in the art from the following detailed description of the best mode for carrying out the invention when taken in conjunction with the accompanying drawings.

BRIEF DESCRIPTION OF THE DRAWINGS

FIGS. 12*a*–12*e* illustrate the response of various engine parameters under control of a system and method according to the present invention with an unconstrained (idealized) control command.

BEST MODE FOR CARRYING OUT THE INVENTION

Figure 1:
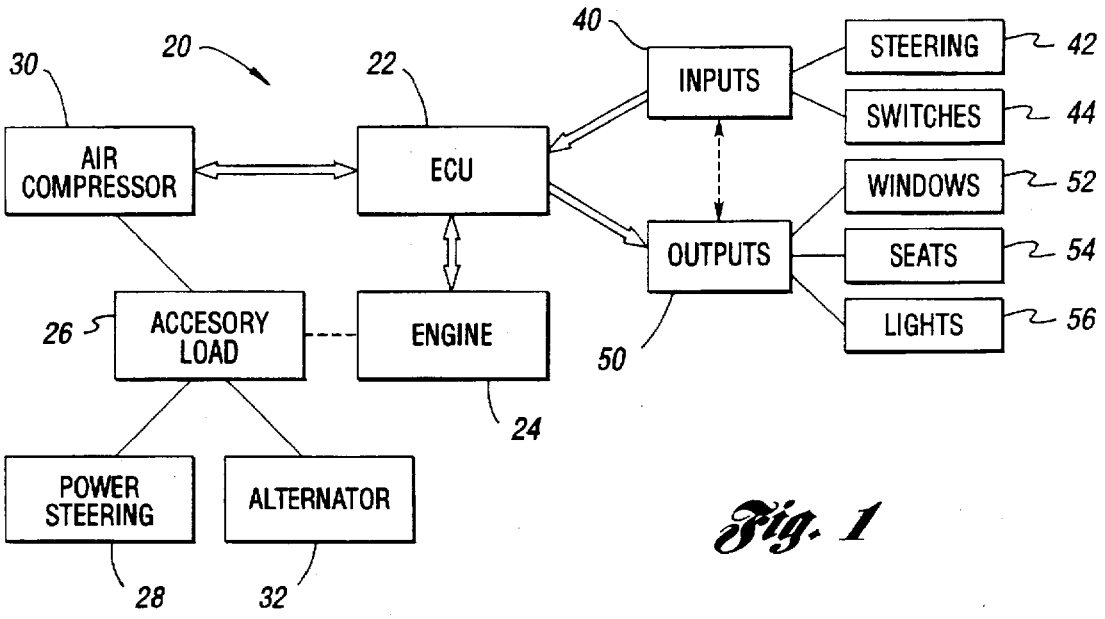
FIG. 1 is a block diagram of a vehicle system incorporating the system and method for idle speed control according to the present invention.

Referring now to FIG. 1, a block diagram illustrating a vehicle system incorporating idle speed control according to the present invention is shown. The vehicle system, indicated generally by reference numeral 20, includes a microprocessor-based electronic control module (ECM) 22 which contains a memory for storing various calibration parameters and engine operating parameters, and control logic for implementing control of engine 24. As is known, the control logic within ECM 22 may utilize a variety of hardware and software to carry out various control functions and strategies. For example, control logic within ECM 22 may include program instructions which are executed by a microprocessor, in addition to dedicated electronic circuits which perform various functions such as signal conditioning, communications, component drivers, and the like.

Engine 24 is subjected to an accessory load as represented generally by block 26. Typically, accessory load 26 is powered by engine 24 via a mechanical connection as indicated by the broken line in FIG. 1. The double lines in FIG. 1 represent exchange of data and control information between ECM 22 and various other vehicle components. As shown, accessory load 26 includes loads induced by power steering 28, air conditioning (AC) 30, and alternator 32. As also indicated, various engine and vehicle accessories may exchange data and control information with ECM 22.

In order to monitor various operating parameters indicative of the current operating condition of the vehicle, system 20 includes various inputs 40 which may include a steering sensor 42, and various switches 44, among numerous other sensors and transducers. System 20 also includes a number of outputs 50 such as power windows 52, power seats 54, and vehicle headlamps 56. Outputs 50 may exchange data and control information with ECM 22, either directly, as illustrated, or indirectly since ECM 22 generally controls and monitors electrical power for the vehicle system.

As also illustrated in FIG. 1, various inputs 40 and outputs 50 may be mechanically or logically linked as indicated by the broken line therebetween. For example, switches 44 may be used to operate lights 56 via ECM 22. Outputs 50 may have integral sensors which indicate a position or state of operation of an associated output.

During operation, ECM 22 implements ISC for engine 24 to minimize variation of engine idle speed as one or more vehicle accessories induce a change in the accessory load 26. ECM 22 contains a load torque disturbance profile for each vehicle accessory which may impose a noticeable torque disturbance resulting in idle speed variation. The initial load torque disturbance profiles may be recorded and stored in ECM 22 during a test sequence, under laboratory conditions, or estimated real-time during normal engine operation. In addition, the present invention provides for modifying one or more of the stored load torque disturbance profiles to reflect changes in operation of the engine and accessories over time.

The ISC control according to the present invention then utilizes these stored profiles to anticipate a torque disturbance prior to its actual occurrence. An impending load disturbance may be indicated in advance, for example, by monitoring the AC switch. To facilitate various system delays, the AC compressor operation is delayed for a short period of time after the switch has been activated. During this period, an artificial torque disturbance is introduced into the system, based on the stored torque disturbance profile, so that the control system may initiate appropriate control actions to minimize subsequent variation of the engine idle speed.

Figure 2:
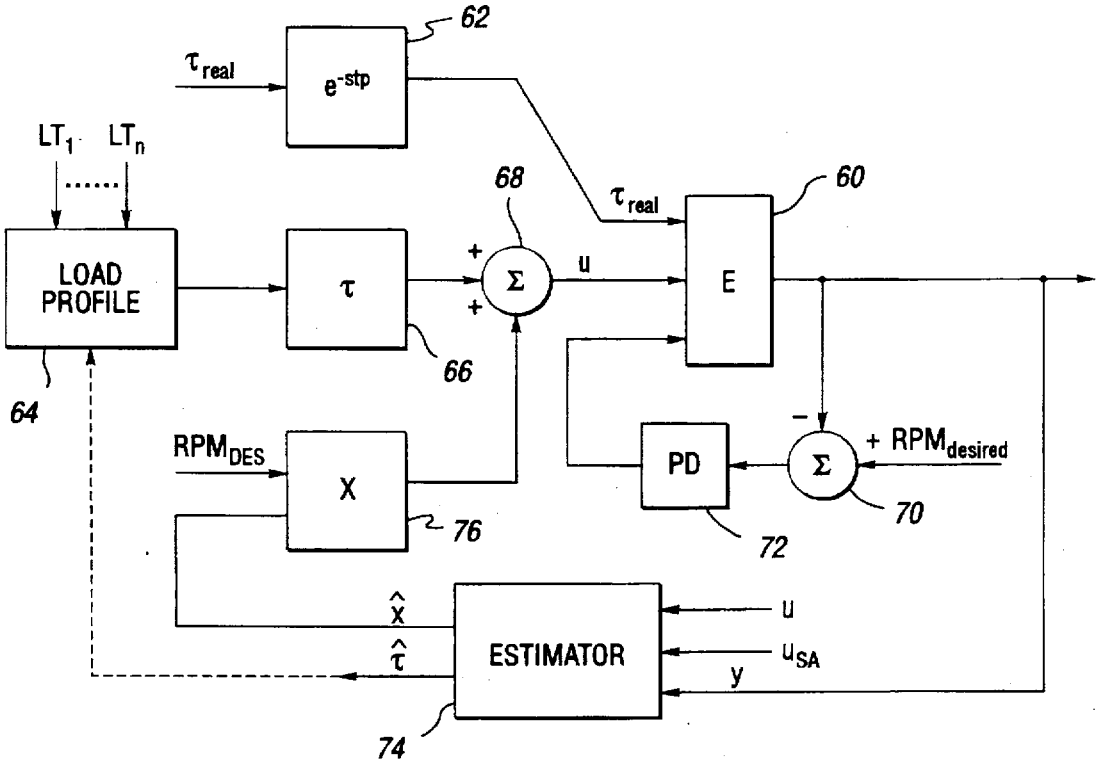
FIG. 2 is a block diagram of a preview control system according to the present invention.

Referring now to FIG. 2, a block diagram illustrating preview idle speed control according to the present invention is shown. The system may be analyzed by assuming that a switch, such as the AC switch, is activated at time t. The actual torque disturbance imposed by the AC compressor will reach the engine at a time $t_p$ seconds later. The time delay, $t_p$, is on the order of a few hundred milliseconds which is substantially imperceptible to the vehicle operator, while allowing sufficient time for the control system to respond. The subsequent torque disturbance can be viewed as a time-shifted, or delayed, torque sequence represented by $\tau(t-t_p)$. This delayed representation in a continuous-time control system results in an infinite number of states which can be approximated using different order Pade approximations, i.e. rational functions, preferably having the degree of the numerator equal to the degree of the denominator, as is well known in the art.

The control system illustrated in FIG. 2 transforms an ideal continuous system to a discrete-time equivalent. A discrete-control system facilitates microprocessor implementation where the update period is represented by $\Delta T$. The update period provides a sufficient time to execute a number of microprocessor instructions while also allowing for various system delays, such as communication delay, and sensor and actuator response times. The discrete state-model may be extended by an additional $N_p$ states corresponding to discrete-time representation of a disturbance torque $\tau(t-t_p)$, where $N_p=t_p/\Delta T$. This represents an optimal setting for disturbance torques which may be characterized as a pulse or white noise. For other types of disturbance torques, which may be represented as step functions, ramp functions, or the like, the state-model should be further augmented as will be appreciated by one of ordinary skill in the art.

As will also be recognized by one of ordinary skill in the art, there are a number of acceptable controller designs for the extended, possibly non-linear, dynamic system model according to the present invention. One embodiment of the present invention is based on a Linear Quadratic Gaussian (LQG) formulation, minimizing a performance index while penalizing excess engine RPM (integral) error and excessive control action. The control action may include operation of the engine bypass valve, or manipulation of the electronic throttle, spark, and fuel inputs. In one embodiment of the present invention, the control action includes only operation of the bypass valve (or equivalently manipulation of the electronic throttle input) and spark advance inputs where the control loop for the spark advance is first closed with an appropriate proportional-differential (PD) controller as shown in FIG. 2.

With continuing reference to FIG. 2, engine controller 60 operates on various inputs to minimize variation of the control parameter (y) representing engine idle speed. An actual disturbance torque imposed by a change in the accessory load is represented by $\tau_{real}$ which is subjected to a time delay 62 of $t_p$ seconds. At time $t_0$, a change in the accessory load is indicated by one or more load triggers $LT_1$ to $LT_n$, which indicate an actual torque disturbance $\tau_{real}$ will follow after the delay $t_p$. Load triggers may be any of a number of switches or sensors such as an AC switch, a steering wheel sensor, a headlamp switch, or the like. Each load trigger has an associated disturbance torque profile stored in memory as indicated by block 64.

Once triggered, one or more of the stored torque disturbance profiles are introduced into disturbance torque preview controller 66. The output of controller 66 is added to the feedback signal from RPM controller 76 at summer 68 to produce input u to engine plant 60. The RPM output of engine plant 60 is fed back through summer 70 where it is combined with a signal representing desired engine RPM. The output of summer 70 passes through spark controller 72 which generates a spark advance signal $U_{SA}$ which is input to engine 60. Preferably, spark controller 72 is a proportional-differential (PD) controller as indicated.

The RPM output of engine plant 60 is also fed back through an estimator 74, in addition to throttle-fuel control signal u, and the spark advance signal $u_{sa}$ generated by spark controller 72. Estimator 74 produces an estimated state-vector signal, which includes manifold pressure and RPM, which is input to RPM controller 76 in addition to a desired RPM signal. Estimator 74 may also provide an estimated torque disturbance signal $\tau$ which may be utilized to provide a learning function for the stored torque disturbance profiles 64. The torque profiles are thus modified to continually adjust for changes in engine and accessory operation.

Once the control system has been designed to utilize predicted torque disturbance profiles as an input, considerable simplification of the control system can be obtained by combining all disturbance torques. In general, disturbance torques may be characterized as electrical (which include all electrical accessories which are powered by the alternator), air conditioning, and power steering. In some cases of simultaneous applications, these disturbances may be combined into a single net disturbance value as seen by the engine crankshaft. This net disturbance value then forms the input to the controller. This eliminates the need to separately tune the controller for various torque disturbances so as to reduce the complexity of optimizing the control system for different vehicle applications.

FIGS. 3 through 6 illustrate methods for estimating torque for each of the characteristic torque disturbances described above. Inputs may be obtained from discrete switches which trigger the predetermined disturbance torque profiles from the system memory, or from sensors which measure appropriate system parameters, such as pressures or currents, from which torque can be inferred.

The individual torque loads are combined to produce a net value which is used as the input to a proportional-differential (PD) controller. The differential, or transient term, is a function of the change in torque seen at each sample period combined with an exponentially decaying transient from previous net torque calculations. This value is combined with a proportional term, which is a function of applied torque and engine speed, to yield a net predictive input to the air controller for the engine. The air controller comprises either the bypass solenoid or the electronic throttle input. This control scheme has been simulated using both linear and non-linear models indicating excellent capability for sustaining steady engine idle speed while the input torque is disturbed.

Figure 3:
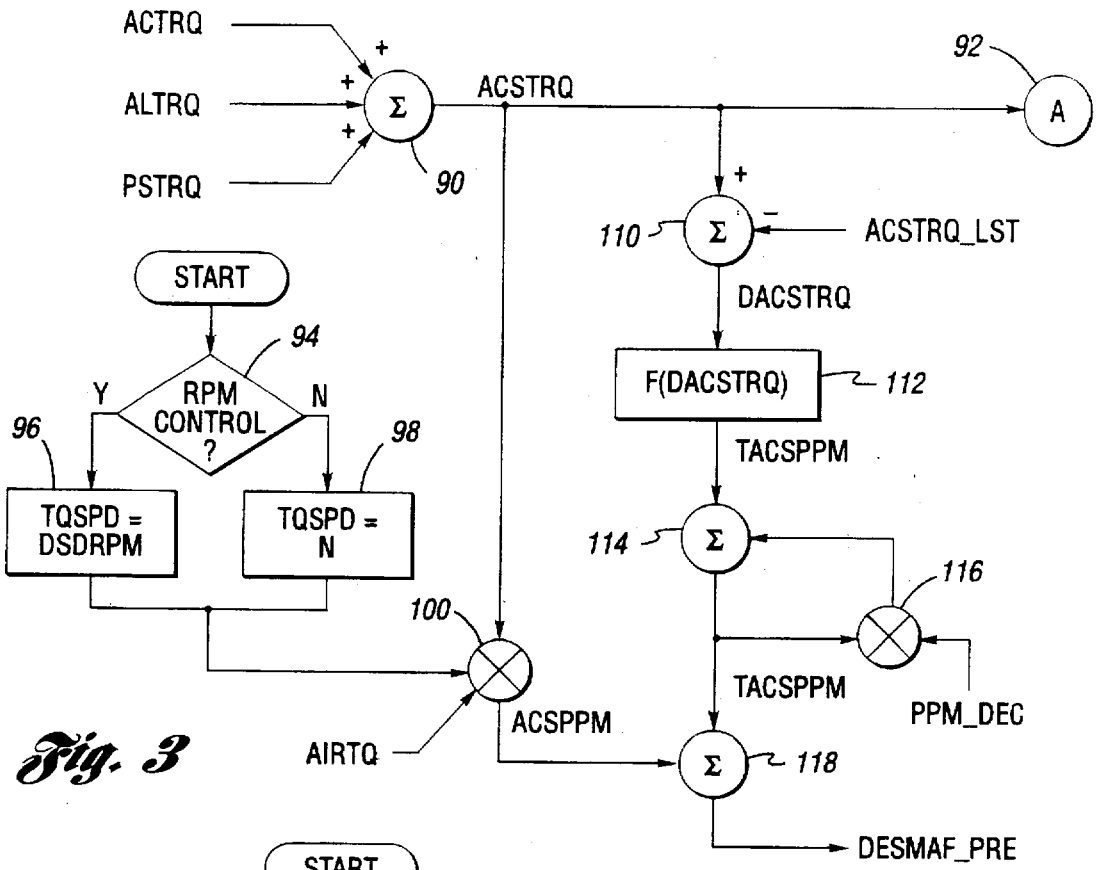
FIG. 3 is a data flow diagram illustrating a net accessory torque calculation according to the present invention.

As illustrated in FIG. 3, AC torque, alternator torque (ALTRQ), and power steering torque (PSTRQ) are added by summer 90 to provide a net disturbance torque as represented by block 92.

The desired engine speed is calculated for use in the air flow equation beginning at block 94. If current operating conditions indicate that RPM control is active, torque speed is set to the desired engine idle speed as indicated by block 96. Otherwise, a torque speed flag is set to no, or false, as indicated by block 98. The value for torque speed is then multiplied by the net torque and a scalar (AIRTQ), as indicated by block 100, to produce air control torque value (ACSPPM). The change in net torque from the previous sampling interval is calculated by block 110 by subtracting the previous value (ACSTRQ_LST) from the current valve (ACSTRQ). This value is used to generate a transient adder which is a function of the change in net torque as indicated by block 112. The transient adder may be produced in any of a number of ways, preferably using a look-up table. The resulting value (TACSPPM) is decremented at block 114 by a portion of its previous value as determined by block 116. Block 118 then calculates the discrete engine speed mass air flow preview value.

Figure 4:
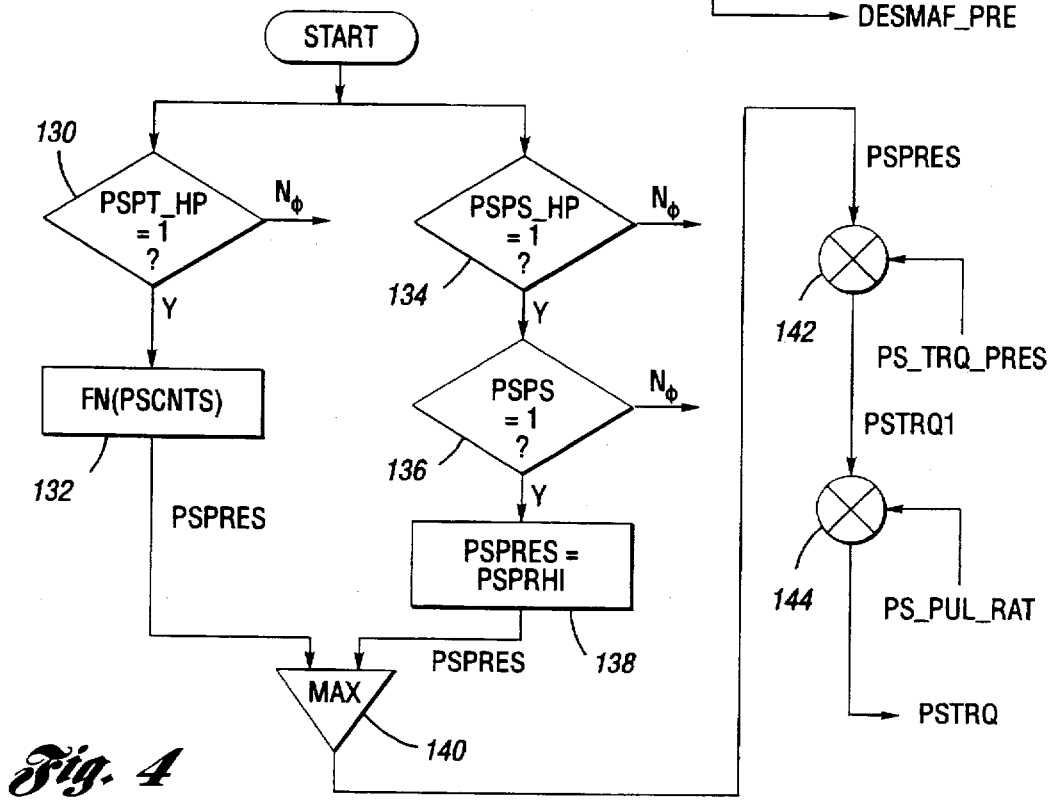
FIG. 4 is a data flow diagram illustrating a power steering torque calculation according to the present invention.

Referring now to FIG. 4, a data flow diagram illustrating a power steering torque calculation according to the present invention is shown. Block 130 examines the PSPT_HP flag which indicates whether a steering position transducer is present. If present, block 132 converts counts generated by the steering sensor to a corresponding pressure. Preferably, this is accomplished via a look-up table. If the flag is not set, as indicated by block 130, then the power steering torque is set to zero. Block 134 determines whether a power steering pressure sensor is configured. If present, and properly functioning as determined by block 136, the power steering pressure (PSPRES) is set to the value measured by the pressure sensor. Otherwise, the power steering torque is set to zero. Block 140 selects the larger of the power steering pressures as determined by a steering position sensor or a pressure sensor.

With continuing reference to FIG. 4, power steering pressure is converted to a torque value by multiplying by a scalar (PS_TRQ_PRES) at block 142. This value is then multiplied by the power steering pulley ratio (PS_PU_RAT) at block 144 to determine the power steering torque disturbance introduced to the engine.

Figure 5:
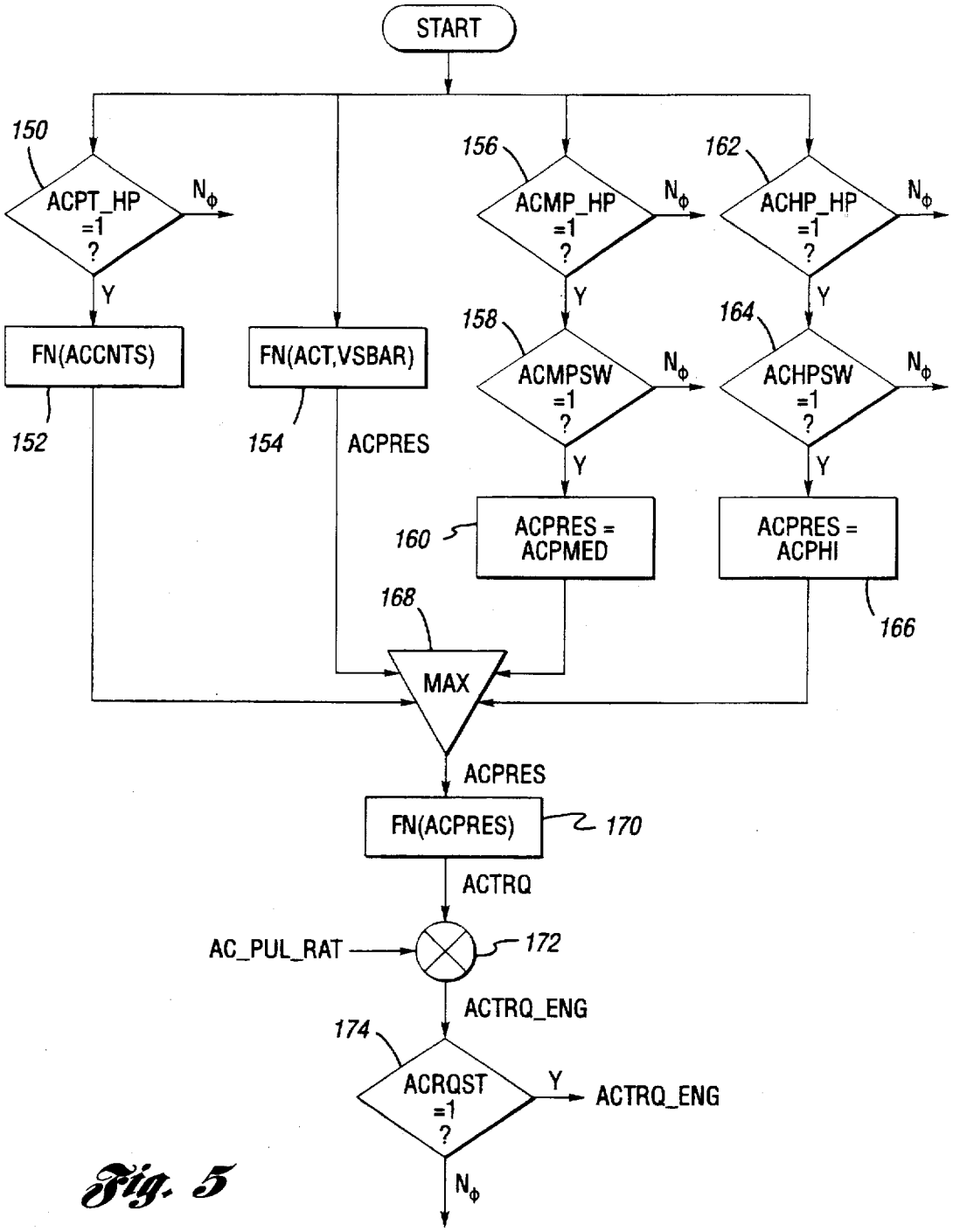
FIG. 5 is a data flow diagram illustrating calculation of air conditioning torque according to the present invention.

Referring now to FIG. 5, a data flow diagram illustrating an AC torque calculation according to the present invention is shown. As illustrated, if the ACPT_HP flag is set as determined by block 150, block 152 converts AC counts to corresponding pressure, preferably via a look-up table. Otherwise, preliminary AC pressure (ACPRES) is set to zero. Similarly, block 154 performs a table look-up to generate a value for ACPRES as a function of the variables ACT and VSBAR.

Blocks 156 and 158 indicate a medium-level AC pressure. The value for ACPRES is then set by block 160 to a predetermined calibration value. Similarly, blocks 162 through 166 determine the value for ACPRES when a high pressure condition is indicated. Blocks 158 and 164 represent the status of a binary pressure switch which is activated when the AC pressure exceeds a predetermined medium and high level, respectively. Block 168 selects the greater value of the various inputs to determine the value for ACPRES. Block 170 then performs another table look-up to convert AC pressure to a corresponding torque (ACTRQ). The torque value is then multiplied by the AC pulley ratio (AC_PUL_RAT) as indicated by block 172. Block 174 is a status flag (ACRQST) indicating a request for AC compressor operation. Thus, if the flag is not set, AC torque is set to zero.

Figure 6:
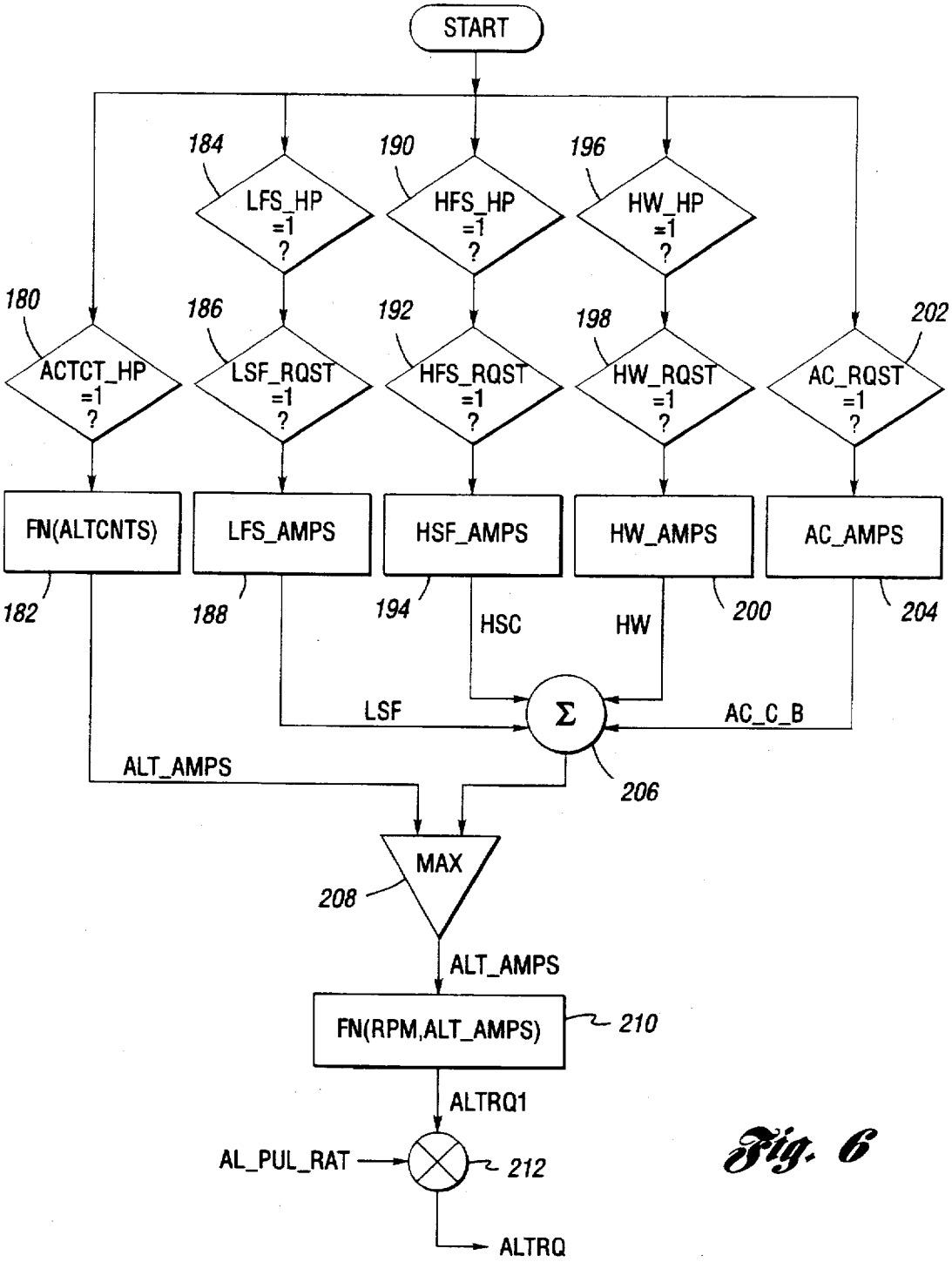
FIG. 6 is a data flow diagram illustrating calculation of alternator torque according to the present invention.

Referring now to FIG. 6, a data flow diagram illustrating an alternator torque calculation according to the present invention is shown. If an alternator current sensor is indicated by block 180, block 182 converts sensor counts to alternator current (ALT_AMPS) by performing a table look-up. Blocks 184 and 186 indicate low-speed cooling fan operation. Block 188 then assigns a corresponding calibration value representing typical low-speed fan current draw. In a similar manner, blocks 190 and 192 determine whether high-speed fan operation is requested. If requested, block 194 assigns a predetermined value representing typical current draw for high-speed cooling fan operation. Blocks 196 and 198 determine whether the vehicle headlamps are operating, while block 200 assigns a corresponding predetermined value representing typical current draw for such operation. Block 202 determines whether the AC clutch and blower are operating and assigns a corresponding predetermined calibration value (AC_AMPS) accordingly. Block 206 then adds the various current values to produce an estimated alternator current draw. Block 208 selects the greater of its inputs to determine a net current draw.

Block 210 converts alternator current to a corresponding torque as a function of engine operating speed by performing a standard table look-up. This torque is then multiplied by the alternator pulley ratio (AL_PUL_RAT) at block 212 to determine the alternator torque load on the engine.

Figure 7:
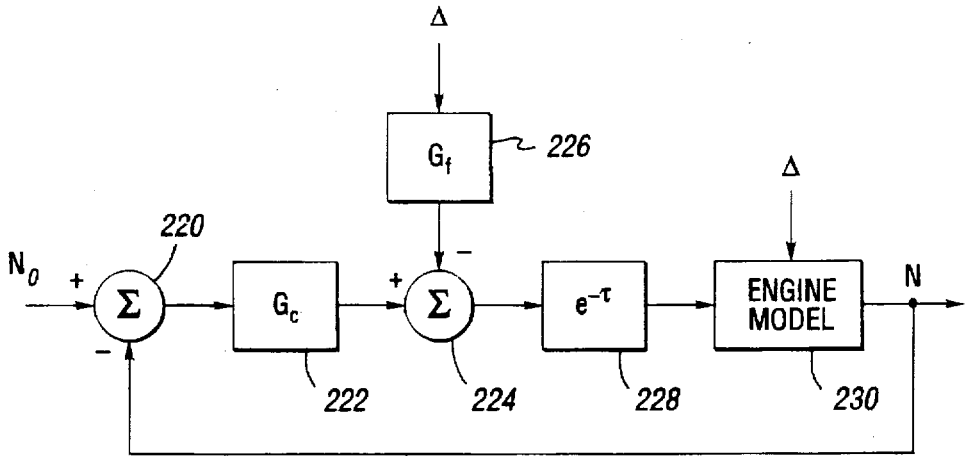
FIG. 7 is a block diagram illustrating an idle speed control system according to the present invention.
Figure 9:
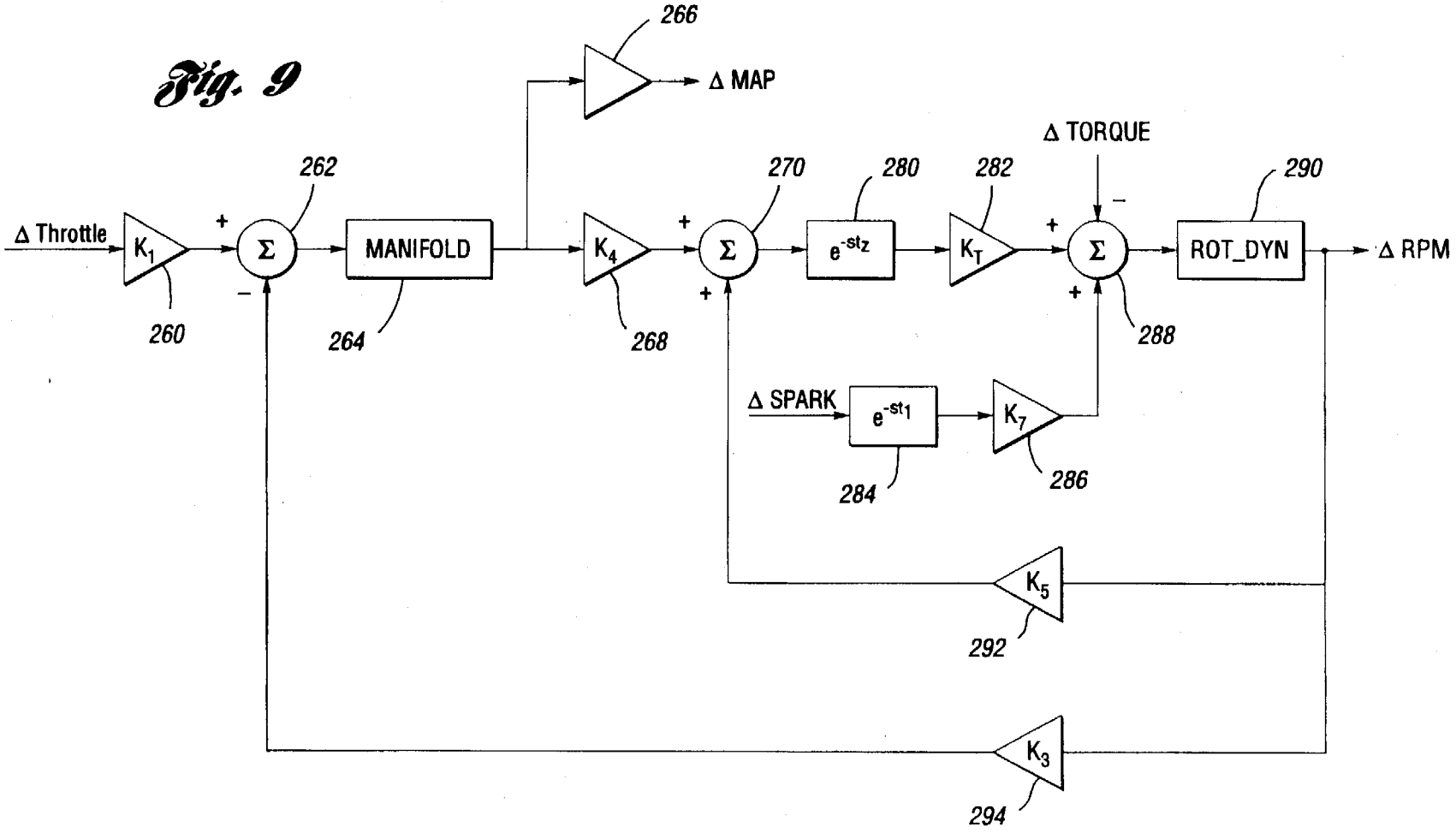
FIG. 9 is a block diagram illustrating a continuous, linear engine model, for use with a control system as illustrated in FIG. 7, according to the present invention.
Figure 10:
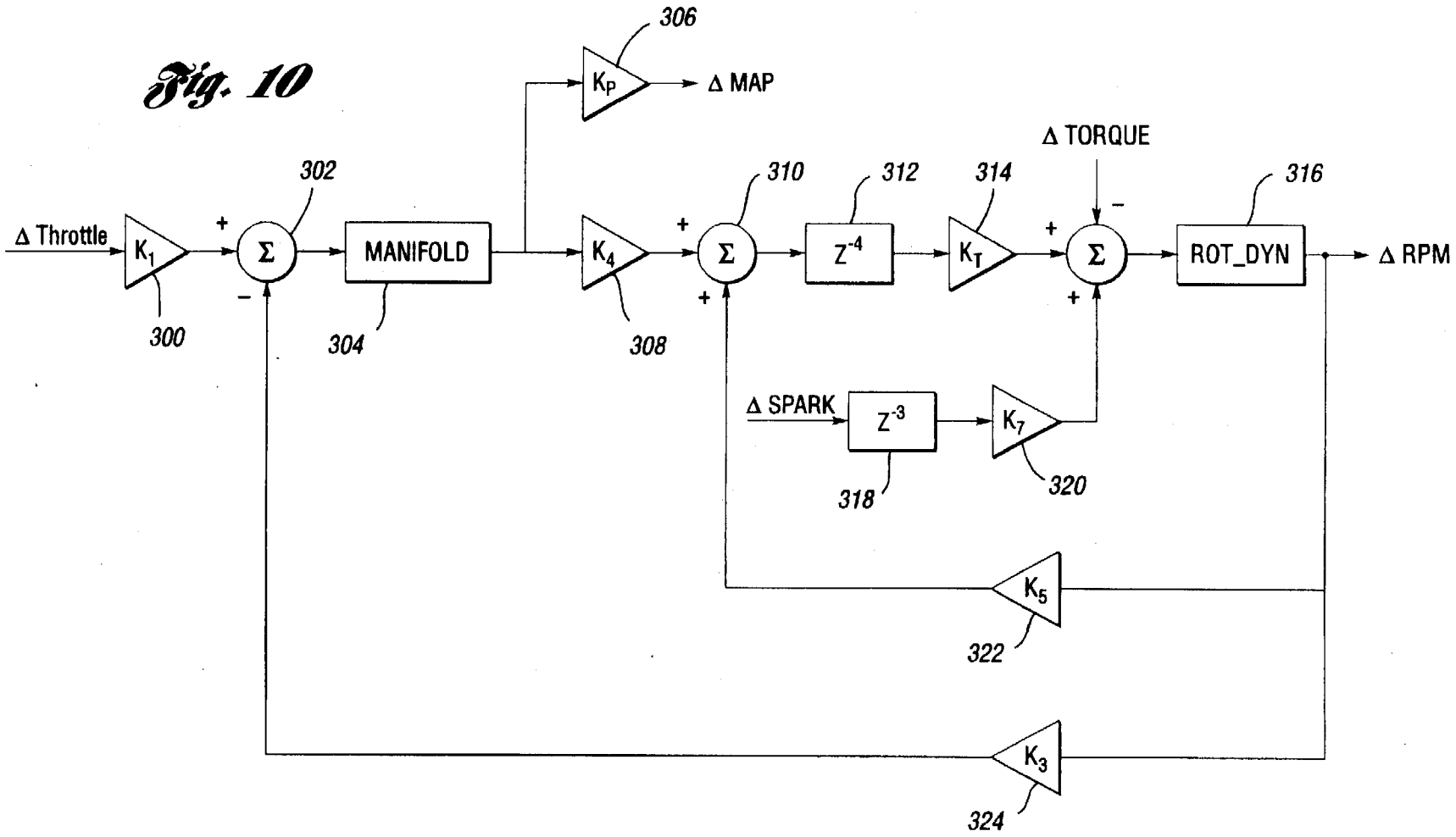
FIG. 10 is a block diagram illustrating a discrete engine model for use with a control system as illustrated in FIG. 7, according to the present invention.

Referring now to FIG. 7, a block diagram illustrating an alternative ISC strategy according to the present invention is shown. As illustrated, a reference engine speed ($N_o$) is input to summer 220 where the actual engine speed (N) feedback loop is closed. The result is multiplied by the feedback controller transfer function ($G_c$) at block 222. The summer 224 combines this result with the result of a torque disturbance (Δ) multiplied by the feedforward, or preview, transfer function ($G_f$) as indicated by block 226. Block 228 represents a time shift imposed by computation delay of the system. The time-shifted result and the torque disturbance Δ are input to the engine model 230 which is illustrated and described in detail with reference to FIGS. 9 and 10. FIG. 9 illustrates a continuous, linear engine model whereas FIG. 10 illustrates a discrete engine model. Of course, other engine models may by developed and utilized without departing from the spirit or scope of the present invention.

From FIGS. 7 and 10, it can be shown that the equation for torque (T) can be expressed as:

$$T=\Delta+K_s z^{-n}\{K_5N+K_4G_M[z^{-(m+1)}G_tK_1\{G_c(N_o-N)-G_f\Delta\}-K_3N]\} \quad (1)$$

where: $z^{-n}$ denotes combustion delay; n represents the sampling interval delay rounded to the nearest integer; $z^{-m}$ denotes actuator response time; and m represents the sampling interval delay rounded to the nearest integer for sampling of the actuator; $G_m$ represents the manifold transfer function; $G_t$ represents the throttle or bypass valve transfer function; $K_1$ represents the bypass valve air flow or throttle gain in LBM/SEC/DEGREE; $K_3$ represents the pumping feedback gain in LBM/SEC/RPM; $K_4$ represents the pressure drop gain; $K_s$ is a gain factor reflecting the increase in volumetric efficiency with engine RPM in PSI/RPM; and $K_T$ represents the torque-pressure gain in ft-lbs/psi. The objective of the feedforward or preview term, $G_f$, is to counteract the torque disturbance Δ before it affects the engine idle speed N. If the actual engine idle speed is unaffected, equation (1) becomes:

$$T|_{N=0}=[1-z^{-(n+m+1)}K_TK_4K_1G_tG_MG_f]\Delta \quad (2)$$

which represents the sum of all the terms in the feed forward path. If the feed forward term is made equal to the following expression:

$$\frac{1}{[Z^{-(n+m+1)}K_1K_4K_TG_tG_m]} \quad (3)$$

then the effect of the disturbance torque Δ on the engine torque T and engine speed N would be eliminated.

The term $z^{-(n+m+1)}$ indicates that the system must anticipate the disturbance torque and apply the preview at a time equal to n+m+1 sample intervals prior to the actual occurrence of the load disturbance. The continuous engine model, as illustrated in FIG. 9, represents the manifold and actuator transfer functions utilizing first order lag equations:

$$G_m(s)=\frac{C_m}{\tau_m s+1} \quad (4)$$

$$G_t(s)=\frac{C_t}{\tau_t s+1} \quad (5)$$

using a bilinear discrete transformation, equations (4) and (5) can be rewritten as:

$$G_m(z)=\frac{K_m(z+1)}{z-a} \quad (6)$$

The functions represented by equations (6) and (7) must be inverted to form $G_f$. Since both equations have $$G_t(z)=\frac{K_t(z+1)}{z-b} \quad (7)$$

numerators of equal or greater order than their corresponding denominators, both equations are causal. However, the resulting poles at z=−1 would cause the control output to oscillate. Thus, it is desirable to move these poles to z=0. The controller still has zeros at z=a and z=b to cancel the corresponding engine poles also located at a and b. The steady-state gain must be corrected after moving the poles from z=1 to z=0.

The steady-state gain may then be expressed as $$\hat{G}_m^{-1}z=k_m\frac{(z-a)}{z}=k_m(1-az^{-1}) \quad (8)$$

which, when evaluated at z=1, produces:

$$k_m=\frac{1}{2K_m} \quad (9)$$

A similar analysis applies to the transfer function for the throttle or bypass valve which yields $$\hat{G}_t^{-1}(z)=k_t\frac{(z-b)}{z}=k_t(1-bz^{-1}),\ k_t=\frac{1}{2K_t} \quad (10)$$

The controller transfer function may now be expressed using equation (3) as:

$$G_f(z)=\frac{\hat{G}_m^{-1}(z)\hat{G}_t^{-1}(z)}{K_1K_4K_T}=\frac{k_m(1-az^{-1})k_t(1-bz^{-1})}{K_1K_4K_T} \quad (11)$$

$$G_f(z)=K_f(1-az^{-1})(1-bz^{-1}) \quad (12)$$

where $$K_f=\frac{k_mk_t}{K_1K_4K_T}=\frac{1}{4K_mK_tK_1K_4K_T} \quad (13)$$

$$G_f'(z)=K_f'(1-az^{-1}) \quad (14)$$

It should be noted that a and b are the discrete equivalents to the manifold and throttle or bypass valve poles, respectively where the poles are the inverse of the time constant.

If an idle bypass valve solenoid is used instead of an actuator (electronic throttle), its time constant may be fast enough to ignore compared to the manifold time constant at engine idle speed. In this case, the controller transfer function, $G_f$ may be simplified to:

$$K_f'=\frac{k_m}{K_1K_4K_T}=\frac{1}{2K_mK_1K_4K_T} \quad (15)$$

If u(z) is the control output and Δ(z) is the control input (representing estimated torque disturbance), then $$G_f'z=\frac{u(z)}{\Delta(z)} \quad (16)$$

which yields $$u(z)=K_f'(1-az^{-1})\Delta(z) \quad (17)$$

This result may be converted via a linear difference equation which is easily implemented by a microprocessor:

$$u(k)=K_f'\{\Delta_{(k)}-a\Delta_{(k-1)}\} \quad (18)$$

where k is the index. Separating the transient and steady-state terms yields:

$$u(k)=K_f'\{\Delta_{(k)}-\Delta_{(k-1)}\}+K_f'(1-a)\Delta_{(k-1)} \quad (19)$$

The resulting controller output is a high magnitude pulse followed by a steady-state offset to match the torque disturbance. However, the pulse may saturate the control output to the bypass valve. In this case, the torque disturbance will not be eliminated. Thus, the delay should be slightly increased until an appropriate compromise is reached.

Compensation for the actuator may be included in the controller such that:

$$G_f(z)=K_f(1-az^{-1})(1-bz^{-1})=\frac{u(z)}{\Delta(z)} \quad (20)$$

where $$K_f=\frac{1}{4K_mK_rK_1K_4K_T} \quad (21)$$

so that $$u(k)=K_f\{\Delta_{(k)}-(a+b)\Delta_{(k-1)}+a+b\Delta_{(k-2)}\} \quad (22)$$

again rewriting to separate the steady-state term and the transient term produces:

$$u(k)=K_f[1-a-b+ab]\Delta_{(k-2)}+K_f[\Delta_{(k)}-(a+b)\Delta_{(k-1)}+(a+b-1)\Delta_{(k-2)}] \quad (23)$$

Figure 8:
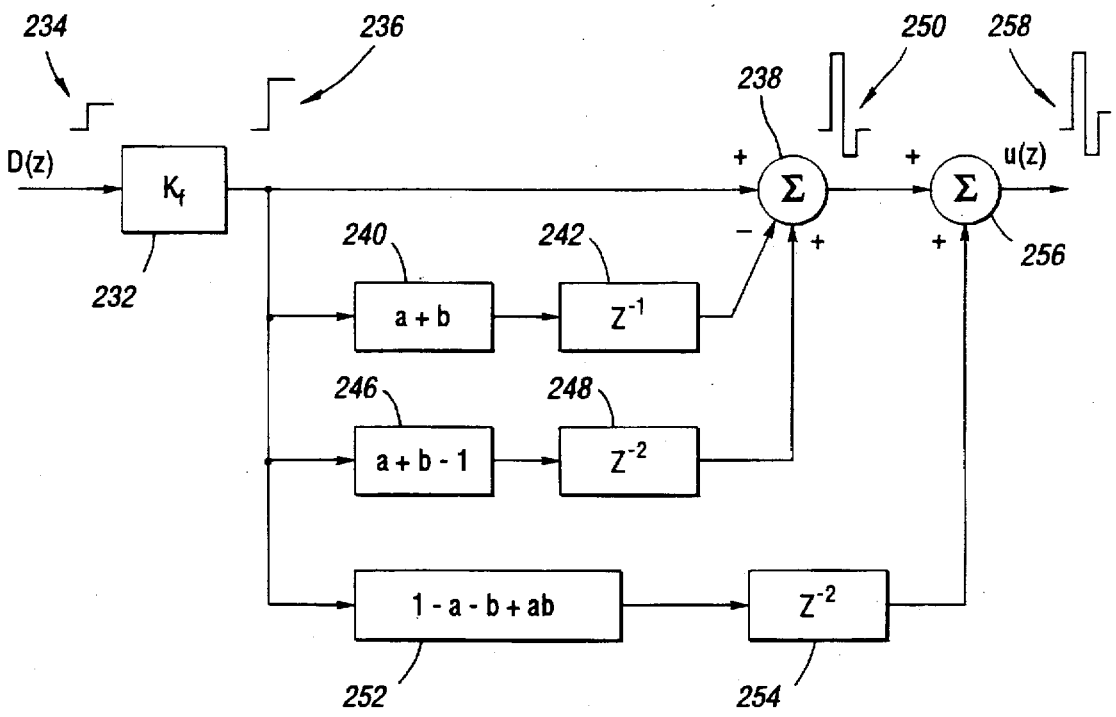
FIG. 8 is a block diagram illustrating the discrete-time equivalent of a transfer function for an idle speed control system according to the present invention.

This is illustrated in the control block diagram of FIG. 8.

Referring now to FIG. 8, to respond to a step input torque disturbance, the controller output 258 will be a large magnitude positive pulse followed by a negative pulse which eventually settles at a steady-state offset value. The step input signal 34 is multiplied by a scaling factor 232 resulting in an amplified step signal 236. This signal is combined with the feed forward terms represented by blocks 240 through 248, by summer 238, to produce pulse 250. Feed forward terms represented by blocks 252 and 254 are then combined with pulse 250 at summer 256 to produce the controller output indicated generally by reference numeral 258. Again, various control system parameters should be adjusted so that the control output is not saturated and does not exceed the range of the control actuator.

Referring now to FIG. 9, a continuous, linear engine model for use in the control system illustrated in FIG. 7 is shown. The various control system constants represent those parameters defined with reference to FIG. 7. The input (Δ throttle) is multiplied at block 260 by $K_1$ which is then combined with the feedback loop at summer 262. The result is then multiplied by the manifold transfer function at block 264. The output of block 264 is then multiplied by a conversion factor at block 266 to produce Δ MAP (change in manifold absolute pressure). The output of block 264 is then multiplied by gain factor $K_4$ at block 268. This result is added to the A RPM feedback after multiplication by gain factor $K_5$ at block 292. The output of summer 270 is multiplied by an intake-to-power delay represented by block 280. This result is then multiplied by gain factor $K_r$ represented by block 282 which is added to the disturbance torque ΔT and spark advance at summer 288. This result is then multiplied by the transfer function representing the rotational dynamics of the engine at block 290 to produce the Δ RPM signal. The change in spark advance, Δ spark, is multiplied by a spark advance delay at block 284 before being multiplied by gain factor $K_7$ at block 286 and input to summer 288.

FIG. 10 illustrates a discrete engine model for use with a control system according to the present invention, such as the control system of FIG. 7. This model functions in a manner analogous to that of the continuous engine model illustrated and described in detail with reference to FIG. 9. However, the continuous delay functions represented by blocks 280 and 284 of FIG. 9 have been replaced by corresponding discrete time delays represented by blocks 312 and 318, respectively.

Figures 11A, 11B, 11C, 11D, 11E:
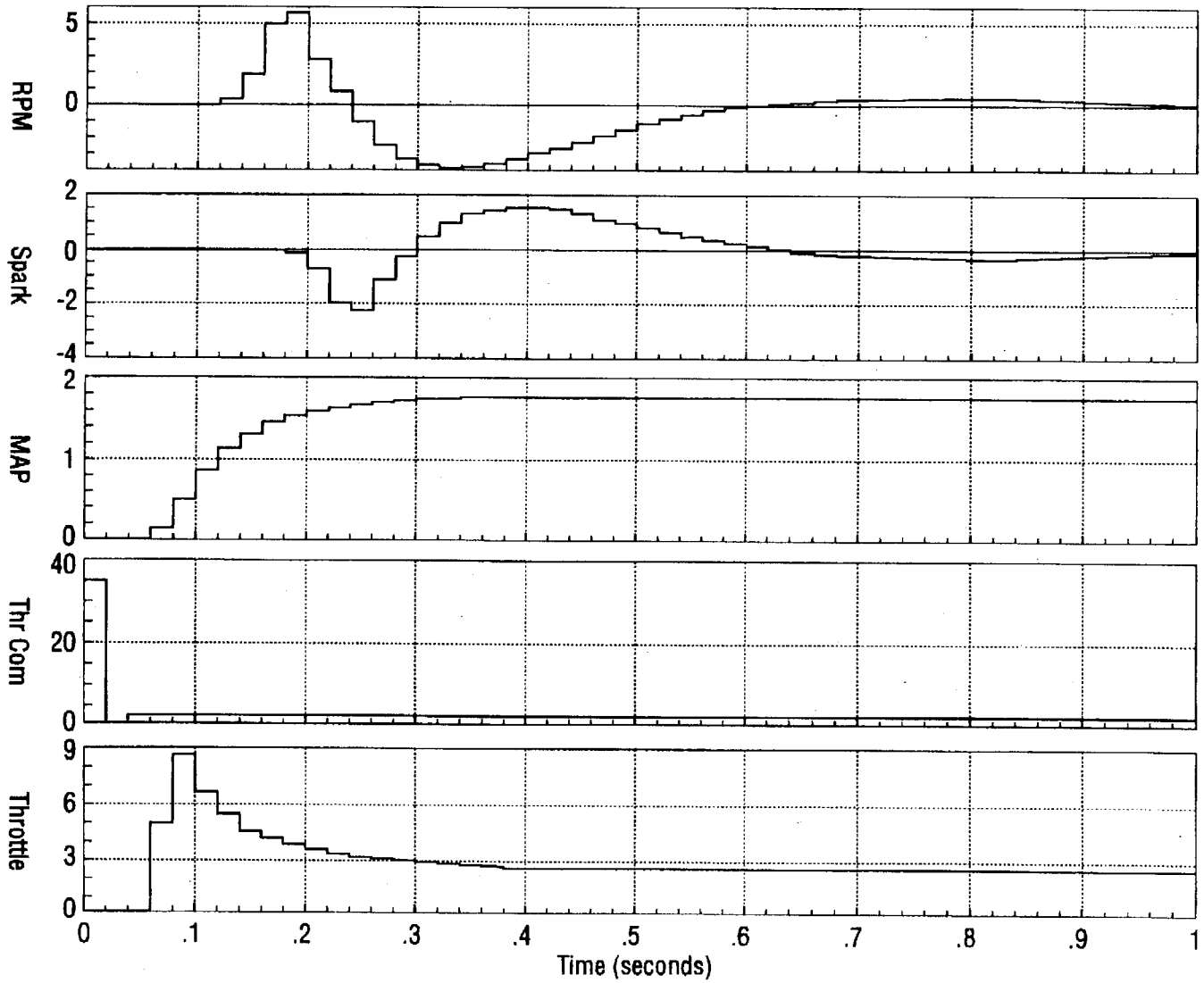
FIGS. 11*a*–11*e* illustrate the response of various engine operating parameters under control of a system and method according to the present invention.
Figures 12A, 12B, 12C:
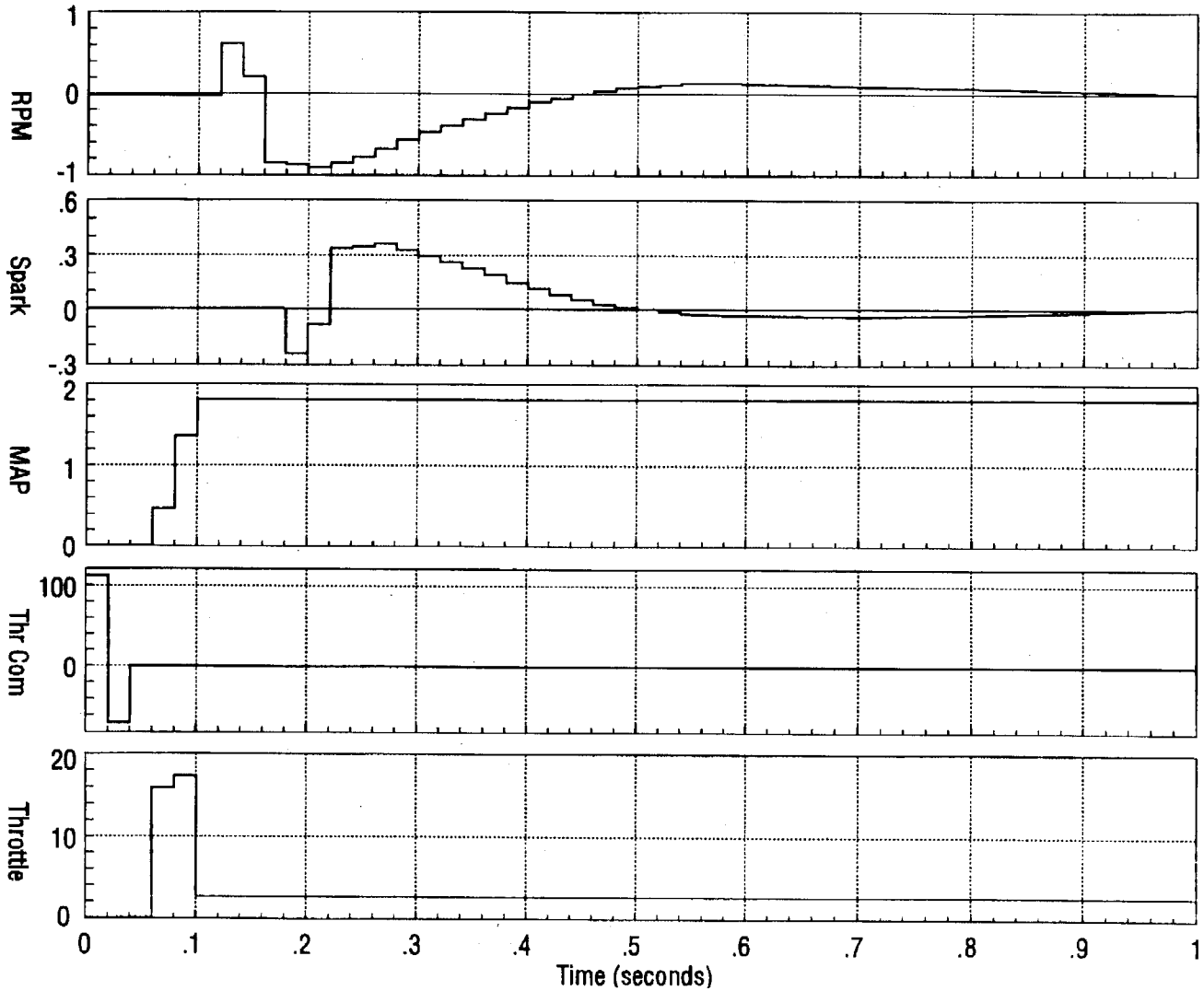

Referring now to FIGS. 11*a* through 11*e*, the response of various engine operating parameters under control of a system and method according to the present invention is shown. A preview torque disturbance is introduced at time t=0, which precedes the actual torque disturbance by approximately 180 milliseconds. FIG. 11*a* illustrates the change in idle speed as a result of the disturbance torque applied at t=0.18 seconds. As shown, idle speed variation is less than 5 RPM for a torque disturbance pulse of about 10 ft-lb.

FIG. 11*b* illustrates spark advance (or retard) as a function of time due to the preview and feedback control system according to the present invention, i.e. various other engine operating conditions may influence the absolute spark advance or retard relative to top dead center.

FIG. 11*c* illustrates the change in manifold absolute pressure (MAP) as a function of time.

FIG. 11*d* illustrates commanded throttle counts while FIG. 11*e* illustrates the actual throttle which is limited to a change of five counts per update interval.

FIGS. 12*a* through 12*e* illustrate the response of various engine parameters operating under preview control with no constraint on the control output command, i.e. the throttle. The delay period has been decreased to approximately 138 milliseconds such that the preview torque disturbance profile is applied at time t=0, and the actual torque disturbance is applied at approximately time t=0.138 seconds. A torque disturbance of approximately 10 ft-lb was applied with a resulting engine idle speed variation of less than 1 RPM. Of course, it is assumed that the magnitude and time of application of the torque disturbance can be estimated with reasonable accuracy.

Empirical results through actual vehicle tests have shown that the preview controller, combined with integral control of the throttle and proportional control of the spark, reduces engine idle speed variation when subjected to a disturbance torque, assuming that the control system is properly tuned.

It is understood, of course, that while the forms of the invention herein shown and described constitute the preferred embodiments of the invention, they are not intended to illustrate all possible forms thereof. It will also be understood that the words used are descriptive rather than limiting, and that various changes may be made without departing from the spirit and scope of the invention disclosed.

What is claimed is:

1. A method for controlling engine idle speed in a vehicle having an electronic control module in communication with an engine and at least one vehicle accessory powered by the engine such that operation of the at least one vehicle accessory causes a torque disturbance in operation of the engine, the method comprising:

storing an estimated torque disturbance profile representing disturbance torque as a function of time for each of the at least one vehicle accessory in the electronic control module;

detecting a request for operation of the at least one vehicle accessory;

generating a signal representing the estimated torque disturbance profile corresponding to operation of the at least one vehicle accessory; and controlling the engine for a period prior to operation of the at least one vehicle accessory based on the generated signal so as to reduce engine idle speed variation.

2. The method of claim 1 wherein the at least one vehicle accessory includes an air conditioning compressor having an associated air conditioning switch and wherein the step of detecting a request comprises detecting a change in state of the air conditioning switch.

3. The method of claim 1 wherein the at least one vehicle accessory includes a power steering pump, the vehicle further includes a steering wheel sensor indicative of rotational displacement of a steering wheel, and wherein the step of detecting comprises monitoring the steering wheel sensor to detect a change in rotational position of the steering wheel.

4. The method of claim 1 wherein the at least one vehicle accessory includes a power steering pressure sensor, and wherein the step of detecting comprises monitoring the power steering pressure sensor to detect a pressure change indicative of power steering load.

5. The method of claim 1 wherein the at least one vehicle accessory includes an alternator, the vehicle includes a switch corresponding to each of the at least one vehicle accessory, and wherein the step of detecting comprises detecting a change in state of the switch.

6. The method of claim 1 further comprising:

modifying at least one of the stored torque disturbance profiles based on an actual torque disturbance caused by operation of at least one of the at least one vehicle accessory.

7. The method of claim 1 wherein the step of controlling the engine comprises controlling an electronic throttle input.

8. The method of claim 1 wherein the step of controlling the engine comprises controlling a bypass valve solenoid.

9. The method of claim 1 wherein the step of controlling the engine comprises modifying spark advance.

10. A system for controlling engine idle speed in a vehicle having an engine and at least one vehicle accessory powered by the engine such that operation of the at least one vehicle accessory causes a torque disturbance in operation of the engine, the system comprising:

a microprocessor in communication with the engine and the at least one vehicle accessory; and a memory in communication with the microprocessor, the memory including an estimated torque disturbance profile representing disturbance torque as a function of time for each of the at least one vehicle accessory and control logic for detecting a request for operation of the at least one vehicle accessory, generating a time-based signal representing the estimated torque disturbance corresponding to operation of the at least one vehicle accessory, and controlling the engine based on the generated time-based signal for a predetermined period prior to operation of the at least one vehicle accessory so as to reduce engine idle speed variation.

11. The system of claim 10 wherein the at least one vehicle accessory includes an air conditioning compressor having an associated air conditioning switch and wherein the memory further includes control logic for detecting a change in state of the air conditioning switch.

12. The system of claim 11 wherein the at least one vehicle accessory includes a power steering pump, the vehicle further includes a steering wheel sensor indicative of rotational displacement of a steering wheel, and wherein the memory further includes control logic for monitoring the steering wheel sensor to detect a change in rotational position of the steering wheel.

13. The system of claim 12 wherein the at least one vehicle accessory includes an alternator, the vehicle includes a switch corresponding to each of the at least one vehicle accessory, and wherein the memory further includes control logic for detecting a change in state of the switch.

14. The system of claim 13 wherein the memory further includes control logic for modifying at least one of the stored torque disturbance profiles based on an actual torque disturbance caused by operation of at least one of the at least one vehicle accessory.

15. The system of claim 10 wherein the microprocessor controls the engine by at least controlling an electronic throttle input.

16. The system of claim 10 wherein the microprocessor controls the engine by at least controlling a bypass valve solenoid.

17. The system of claim 10 wherein the microprocessor controls the engine by at least modifying spark advance.

* * * * *